US006497205B2

(12) United States Patent
Kumaki et al.

(10) Patent No.: US 6,497,205 B2
(45) Date of Patent: Dec. 24, 2002

(54) VALVE CONTROL SYSTEM FOR ELECTROMAGNETIC VALVE

(75) Inventors: Hiroshi Kumaki, Kanagawa (JP); Ikuhiro Taniguchi, Kanagawa (JP); Taketoshi Kawabe, Yokohama (JP); Shigeru Nakajima, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/860,582

(22) Filed: May 21, 2001

(65) Prior Publication Data

US 2001/0054399 A1 Dec. 27, 2001

(30) Foreign Application Priority Data

Jun. 2, 2000 (JP) ..... 2000-166533

(51) Int. Cl.[7] ..... F01L 9/04
(52) U.S. Cl. ..... 123/90.11; 251/129.15
(58) Field of Search ..... 123/90.11; 137/1; 251/129.15, 129.16

(56) References Cited

U.S. PATENT DOCUMENTS 4,614,170 A * 9/1986 Pischinger et al. ..... 123/90.11
6,286,532 B1 * 9/2001 van Nieuwstadt et al. ..... 137/1

FOREIGN PATENT DOCUMENTS

JP 11-159313 6/1999

* cited by examiner

*Primary Examiner*—Thomas Denion
*Assistant Examiner*—Jaime Corrigan
(74) *Attorney, Agent, or Firm*—Foley & Lardner

(57) ABSTRACT

A valve control system for controlling an electromagnetic valve unit is arranged to execute an initialization control for moving a movable member to a start position by alternatively energizing valve opening and closing electromagnets according to a natural frequency of a vibration system of the electromagnetic valve unit. The valve control system detects amplitudes of oscillation of the movable member during the initialization control and calculates an increase-degree of the detected amplitudes. Further, the valve control system estimates a friction quantity of the vibration system on the basis of the calculated increase-degree and controls electric current supplied to the electromagnets on the basis of a control parameter reflecting the estimated friction quantity.

15 Claims, 7 Drawing Sheets

VALVE CONTROL SYSTEM FOR ELECTROMAGNETIC VALVE

BACKGROUND OF THE INVENTION

The present invention relates to a control system for controlling an electromagnetically operated valve, and more particularly to an electromagnetic valve control system which is capable of executing a soft landing of a movable member onto an electromagnet in a valve open/close control.

In recent years, there have been proposed various electromagnetic valve operating systems that employ an electromagnetic actuator comprised of a movable member, a pair of electromagnets and a pair of springs so as to reciprocatingly operate intake and exhaust valves of an internal combustion engine. Generally, it is preferable that a movable member of such a valve operating system is softly landed on an electromagnet while ensuring a required motion performance. A Japanese Patent Provisional Publication No. (Heisei)11-159313 discloses a landing method for softly landing a movable member on an electromagnet in an electromagnetic valve operating system. Such soft landing in this system is achieved by temporally switching off the electromagnet during a period between a switch-on moment of the electromagnet and the landing moment of the movable member. Further, in order to realize a further accurate landing control of an electromagnetic valve unit including a valve and an electromagnetic actuator, there has been proposed a control method employing a characteristic representative of a vibration system of the electromagnetic valve unit.

SUMMARY OF THE INVENTION

However, the characteristic of the vibration system of the controlled electromagnetic valve unit is varied according to an operating condition. Particularly, a friction in the electromagnetic valve unit is largely affected by a temperature since the friction largely depends on a characteristic of lubricating oil whose viscosity is varied according to the change of temperature. Therefore, it is difficult to stably execute a required landing control only by a preset characteristic representative quantity.

It is therefore an object of the present invention to provide a control system which further certainly executes a soft landing control of an electromagnetic valve unit by varying a model constant of the vibration system of a controlled electromagnetic valve unit according to an actual operating condition.

An aspect of the present invention resides in a valve control system which comprises an electromagnetic valve unit and a controller. The electromagnetic valve unit comprises a valve, a pair of electromagnets arranged in spaced relationship from one another in axial alignment with the valve so as to form a space, a movable member axially movably disposed in the space between the electromagnets and interlocked with the valve, a pair of springs biasing the movable member so as to locate the movable member at an intermediate portion of the space when both of the electromagnets are de-energized. The controller is connected to the electromagnetic valve unit and executes an initialization control for moving the movable member to a start position by repeatingly energizing the electromagnets according to a natural frequency of a vibration system of the electromagnetic valve unit. The controller detects amplitudes of oscillation of the movable member during the initialization control, calculates an increase-degree of the detected amplitudes, and estimates a friction quantity of the vibration system on the basis of the calculated increase-degree.

DETAILED DESCRIPTION OF THE INVENTION

Referring to FIGS. 1 to 11, there is shown an embodiment of a control system for electromagnetically operated engine valves in accordance with the present invention.

Figure 1:
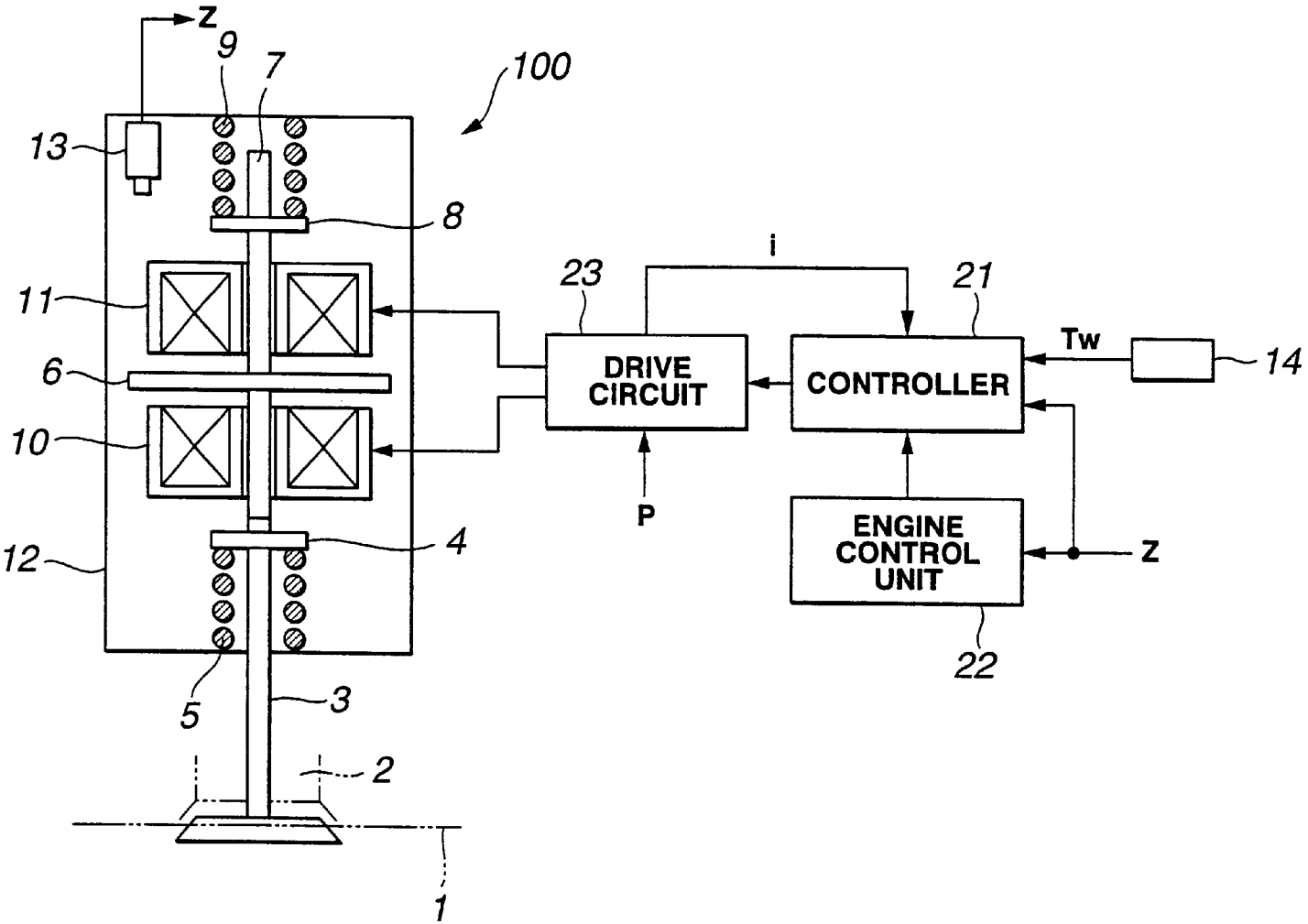
FIG. 1 is a schematic view showing a control system of electromagnetically operated engine valve according to an embodiment of the present invention.

As shown in FIG. 1, the control system according to the present invention is adapted to control intake and exhaust valves of an internal combustion engine for an automotive vehicle. Four valve units 100 are provided to each cylinder of the engine. Two of valve units 100 perform as intake valves, and the other two of valve units 100 perform as exhaust valves. More specifically, by each cylinder of the engine, two intake ports communicated with an intake passage and two exhaust ports communicated with an exhaust passage are formed in a cylinder head 1. In order to facilitate the explanation the structure of the valve units 100, one of the valve units 100 will be discussed.

A valve 3 of each valve unit 100 is installed to one port 2 of intake and exhaust ports. Valve 3 penetrates a lower wall of a housing 12, and is reciprocally movable while being supported by cylinder head 1. A retainer 4 is fixed to a top end portion of valve 3. A valve closing spring 5 is installed between retainer 4 and a wall of cylinder head 1 faced with retainer 4, and biases valve 3 into a valve closing direction.

A plate-like movable member 6 made of soft magnetic material is integrally connected to a guide shaft 7. A lower tip end of guide shaft 7 is in contact with an upper end of valve 3. A retainer 8 is fixed to an upper portion of guide shaft 7. A valve opening spring 9 is installed between retainer 8 and an upper wall of housing 12. Valve opening spring 9 biases movable member 6 integral with guide shaft 7 into the valve opening direction, and therefore valve 3 is biased into the valve opening direction by valve opening spring 9 through guide shaft 7. Accordingly, valve 3 and movable member 6 are integrally movable in reciprocating motion. When valve 3 and movable member 6 are put in the contacted state, valve closing and opening springs 5 and 9 bias movable member 6 at a neutral position shown in FIG. 1. Although this embodiment according to the present invention has been shown and described such that a shaft of valve 3 is separable from guide shaft 7, it will be understood that valve 3 and guide shaft 7 are integrally formed.

A valve opening electromagnet 10 is disposed below movable member 6 while having a predetermined clearance from movable member 6, and a valve closing electromagnet 11 is disposed above movable member 6 while having a predetermined clearance from movable member 6. Therefore, movable member 6 is movably disposed in a space between valve opening and closing electromagnets 10 and 11. Both valve opening and closing electromagnets 10 and 11 have guide holes respectively, and guide shaft 7 is reciprocatingly supported to these guide holes. The neutral position of movable member 6 is located at a generally center (intermediate) position between valve opening and closing electromagnets 10 and 11.

A position sensor 13 is installed in housing 12 and detects a position of movable member 6 in the axial direction. In this embodiment, a laser displacement meter is employed as position sensor 13.

A controller 21 of the control system receives a valve opening/closing command from an engine control unit 22 and outputs an energizing signal to a drive circuit 23 on the basis of the received valve opening/closing command to energize valve opening electromagnet 10 or valve closing electromagnet 11. Drive circuit 23 supplies electric current from an electric source (not-shown) to each electromagnet 10, 11 so as to apply suitable electromagnetic force to movable member 6.

Further, controller 21 receives a temperature signal indicative of a lubrication oil temperature from a temperature sensor 14 and a current i to be supplied to each electromagnet 10, 11 from drive circuit 23. In this embodiment, a coolant temperature signal Tw indicative of an engine coolant temperature is inputted to controller 21 as a temperature corresponding to a lubrication oil temperature.

Next, the manner of operation of valve unit 100 will be discussed.

The respective valve closing and opening springs 5 and 9 have been designed so that movable member 6 is positioned at the neutral position due to the biasing forces of springs 5 and 9 when both electromagnets 10 and 11 are de-energized.

When the operation of movable member 6 is started, an initialization control for positioning movable member 6 at a seated (landing) position on valve closing electromagnet 11 is executed in order to decrease energy consumption and to lower a production cost of a current supply circuit of electromagnets 10 and 11.

The initialization control employed in this embodiment is a method in that an amplitude of alternative displacement of movable member 6 is gradually increased by alternatively supplying electric current to electromagnets 10 and 11 and at last movable member 6 reaches a predetermined initial position corresponding to the valve full close position. More specifically, valve unit 100 is represented as a mass-spring vibration system which is constituted by springs 5 and 9 and movable parts including valve 3, movable member 6 and guide shaft 7. A natural frequency $f_0$ of the mass-spring vibration system is represented by the equation $f_0=2\pi\sqrt{K/m}$ where a composed spring constant of springs 5 and 9 is K, and a total inertial mass of movable parts is m. By alternatively switching on valve opening and closing electromagnets 10 and 11 at a cycle corresponding to this natural frequency $f_0$, the mass-spring vibration system generates a resonance and achieves the initialization control (hereinafter, this initialization is called "resonance initializations").

Normal valve operation of each of intake and exhaust valves is started after completing the resonance initialization. For example, when valve 3 put in a closed position is moved to an opened position, valve closing electromagnet 11 is first de-energized. In reply to the de-energizing operation of valve closing electromagnet 11, movable member 6 is basically displaced downward due to the forces of springs 5 and 9. Movable parts of valve unit 100 generates energy loss due to some friction based on a viscosity of lubrication oil. In order to cancel this energy loss and to maintain the normal valve operation, valve opening electromagnet 10 is energized during an opening process of movable member 6.

Figure 2:
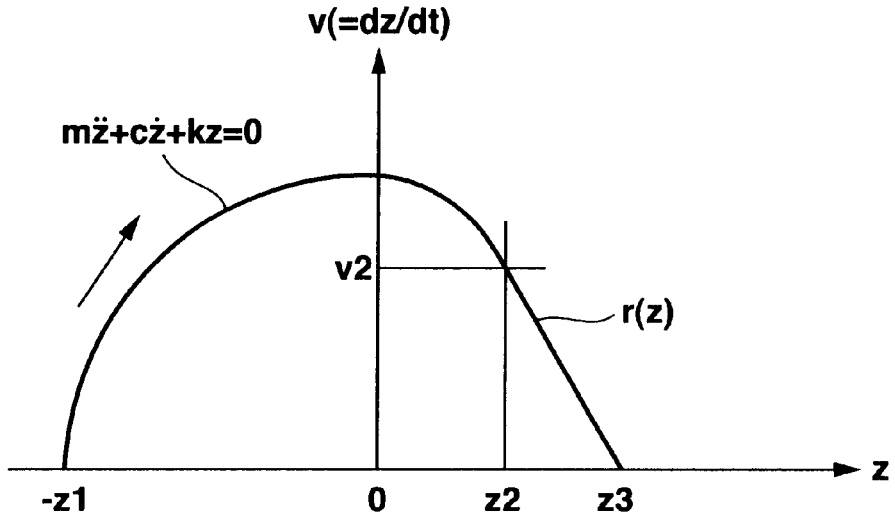
FIG. 2 is a movable member velocity function employed in a landing control by the control system of FIG. 1.

A graph of FIG. 2 shows a locus of movable member 6. In this graph, a horizontal axis represents a position z of movable member 6 when the neutral position of movable member 6 is set at an origin point, and a vertical axis represents a velocity v of movable member 6 at the position z. By de-energizing valve closing electromagnet 11, movable member 6 to have been attracted by valve closing electromagnet 11 starts free vibration from a position z=−z1 (where z1>0). In this situation, the motion in this vibration system is generally determined by the following equation (1).

$$m\ddot{z}+c\dot{z}+kz=0 \tag{1}$$

In this equation (1), c is a damping coefficient and particularly denotes a magnitude of friction.

At the moment when movable member 6 is displaced to a position where magnetic force of valve opening electromagnet 10 becomes effective to movable member 6, valve opening electromagnet 10 is energized. Movable member 6 is biased by this magnetic force of valve opening electromagnet 10 and is displaced to a predetermined position (z=z3). By supplying a predetermined electric current to valve opening electromagnet 10 during this period, movable member 6 is accelerated as movable member 6 approaches valve opening electromagnet 10. In order prevent a radial collision between movable member 6 and valve opening electromagnet 10, a landing control for softly landing movable member 6 on valve opening electromagnet 10 is executed by decelerating the velocity v of movable member 6.

Figure 3:
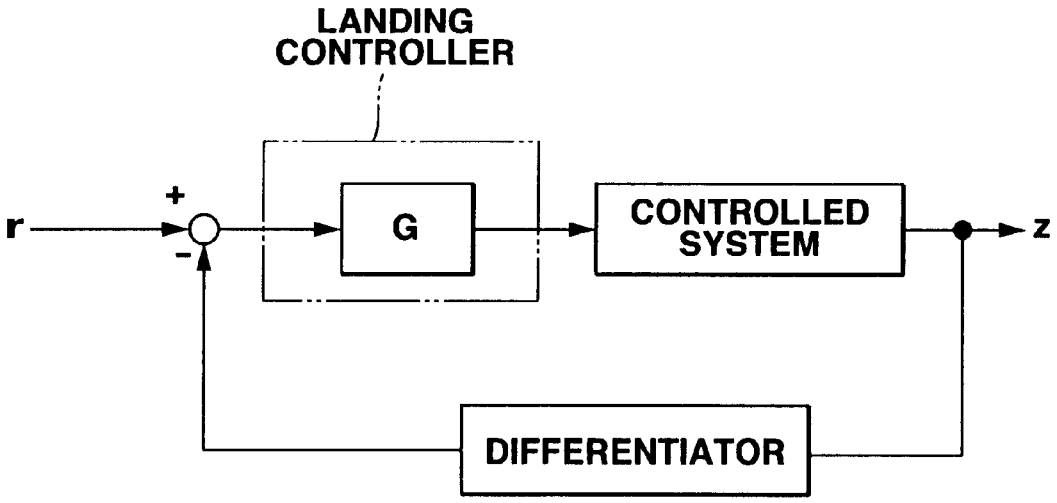
FIG. 3 is a block diagram of a feedback control system of the control system schematic view showing an embodiment of the present invention.

In order to achieve this landing control (collision preventing control), velocity v of movable member 6 after starting energizing valve opening electromagnet 10 is controlled at a target velocity r according to the position z by means of a feedback control shown in FIG. 3. In this control system, controller 21 detects velocity v of movable member 6 and outputs the energizing command so that the detected velocity v follows up the target velocity r. By energizing valve opening electromagnet 10 through drive circuit 23 according to the energizing current, it becomes possible to land movable member 6 on valve opening electromagnet 10 at a predetermined velocity such as 0.1 (m/s) or less. Further, it becomes possible to stop movable member 6 at a position where movable member 6 has a predetermined gap with respect to valve opening electromagnet 10 and to maintain movable member 6 at the gapped position until the next closing operation is executed.

Although only the operation of valve unit 100 during the valve opening period has been discussed hereinabove, the operation during the valve closing period is also executed as is similar to that during the valve opening period. Therefore, the explanation of the operation during the valve closing period is omitted herein.

When the above mentioned landing control is executed, the accuracy of the control is improved by employing a model constant such as mass m, friction c and spring constant K for a controlled system of valve unit 100. However, friction c tends to largely vary according to the change of a temperature particularly to the change of oil temperature.

With the thus arranged valve control system according to the present invention, it is possible to estimate friction c from a waveform of movable member 6 during the resonance initialization and to reflect the estimate friction c in the landing control.

Figure 4:
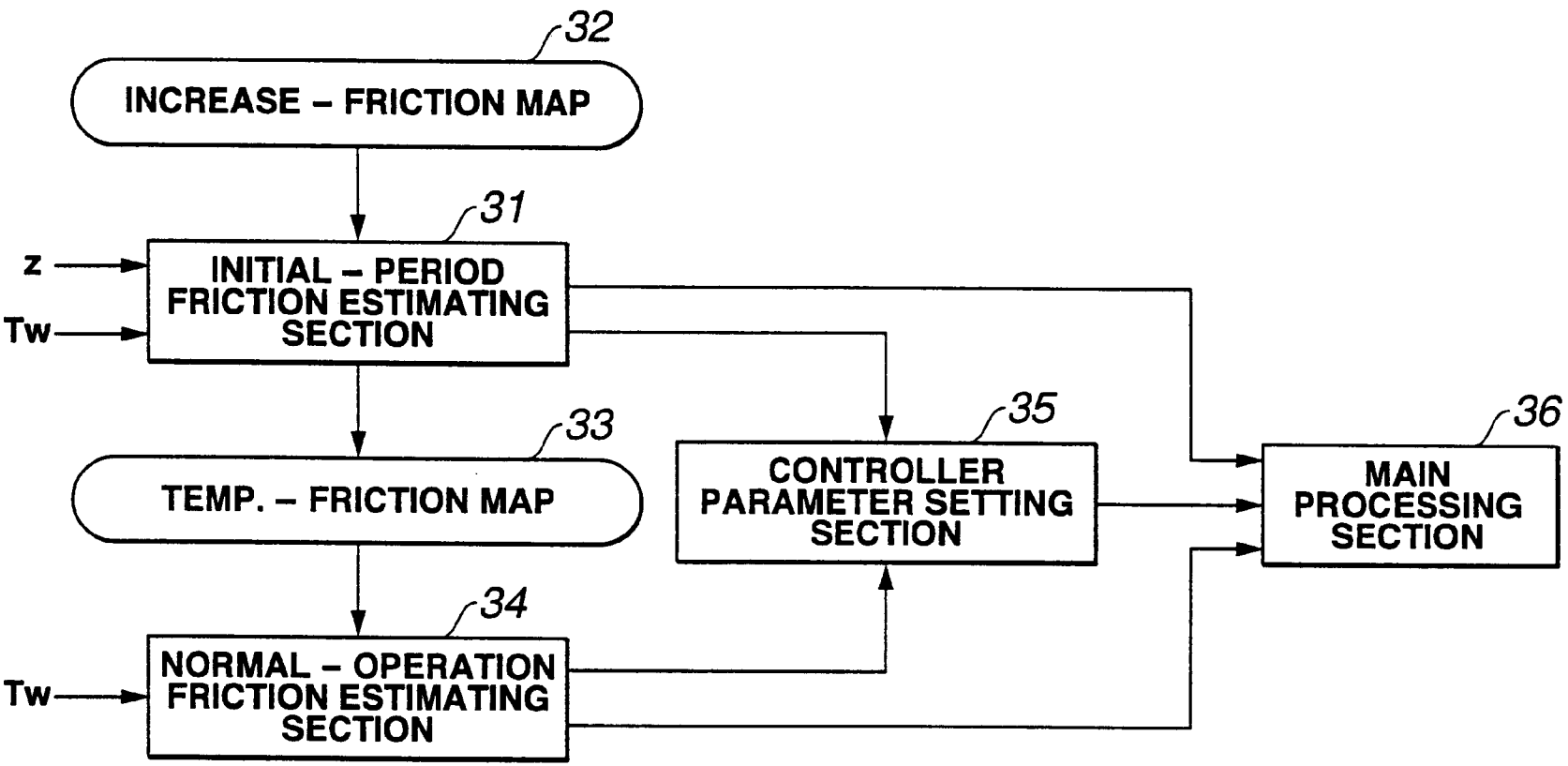
FIG. 4 is a block diagram showing a structure of a controller in the control system.

FIG. 4 shows a block diagram of controller 21 of the valve control system according to the present invention.

An initial-period friction estimating section 31 of controller 21 reads position z during the resonance initialization control and detects an increase-degree α of an amplitude of the initialization oscillation of movable member 6. Initial-period friction estimating section 31 estimates friction c at the present temperature on the basis of the detected increase-degree α and an increase-friction map 32 previously provided in controller 21. Increase-friction map 32 represents a relationship between the increase-degree α and the friction c.

Controller 21 stores the estimated friction c with the coolant temperature Tw at the estimated period in the friction-temperature map 33 in the form of a temperature-friction relationship. When the detected coolant temperature Tw corresponds to the coolant temperature stored in the map 33, the estimated friction c at the detected coolant temperature Tw is stored instead of the previously stored friction data.

A normal-operation friction estimating section 34 of controller 21 estimates the friction c at the present temperature on the basis of the detected coolant temperature Tw and with reference to the temperature-friction map 33. When the detected coolant temperature Tw does not correspond to the stored temperature, friction c is interpolated from the stored two temperature-friction data adjacent to the detected coolant temperature.

A control parameter setting section 35 of controller sets an optimum control parameter PRM on the basis of friction c estimated at initial-period fiction estimating section 31 or normal-operation friction estimating section 34. For example, the control gain (feedback gain) G of the landing controller shown in FIG. 3 may be varied according to friction c.

A main processing section 36 outputs energizing commands to drive circuit 23 for energizing valve opening electromagnet 10 and valve closing electromagnet 11, respectively, upon taking account of the estimated friction c and the set control parameter PRM when main processing section 36 receives valve opening/closing command from an engine control unit 22.

Figure 5:
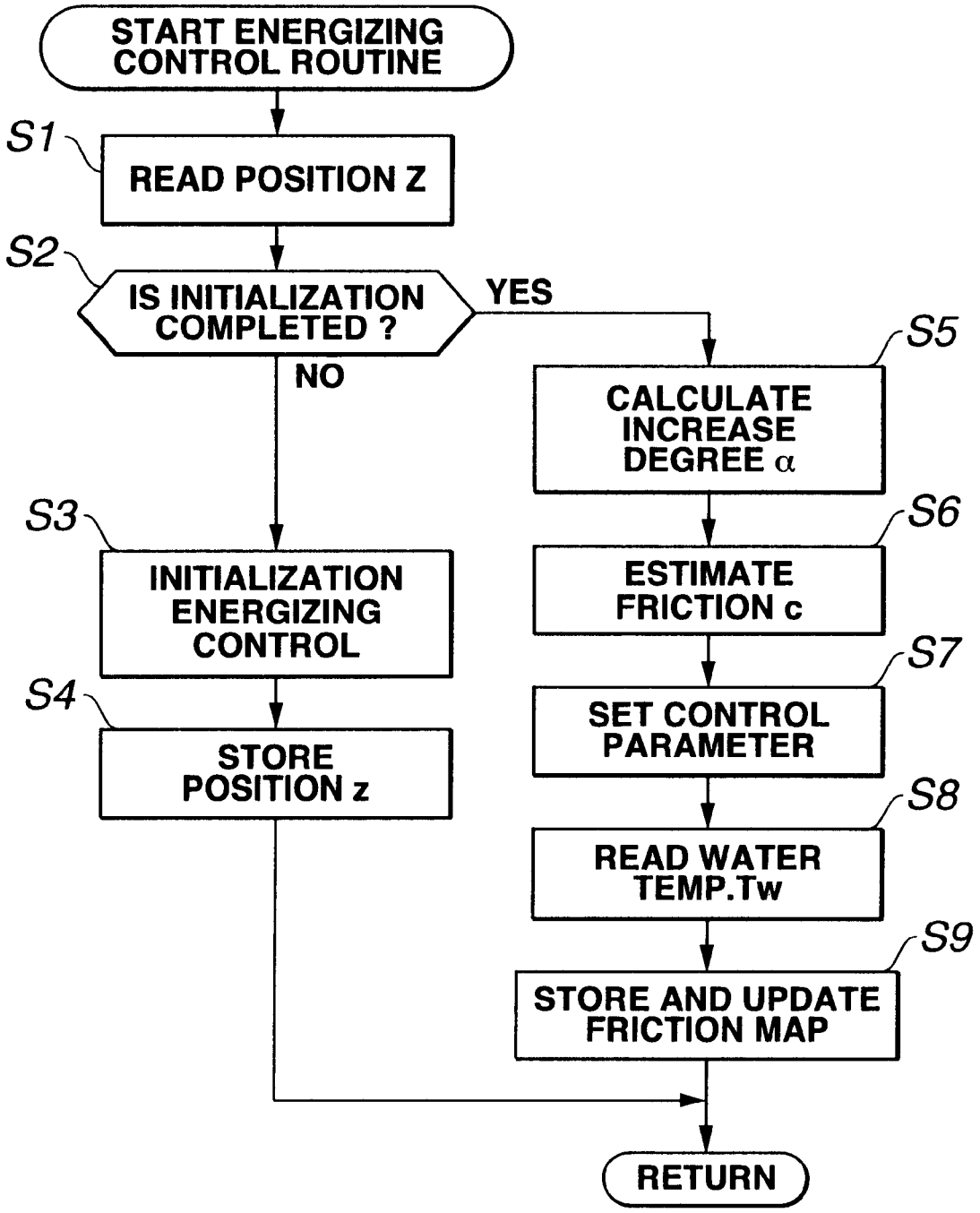
FIG. 5 is a flowchart showing an energizing control routine at the starting condition.

Next, the control procedure of controller 21 will be discussed with reference to a flowchart of FIG. 5, which shows a resonance initialization control routine executed at the start of valve unit 100. This flowchart executes the resonance initialization control and the estimation of friction c.

At step S1, controller 21 reads the position z of movable member 6.

At step S2, controller 21 decides whether the resonance initialization has been completed or not. In this embodiment, controller decides whether movable member 6 reaches the initial position in order to decide the completion of the resonance initialization. When the decision at step S2 is negative, that is, when the resonance initialization has not been completed, the routine proceeds to step S3. When the decision at step S2 is affirmative, the routine proceeds to step S5.

At step S3, controller 21 commands drive circuit 23 to alternatively switch on valve opening and closing electromagnets 10 and 11 so as to increase the amplitude of the oscillation of movable member 6.

At step S4, controller 21 stores a present position z.

Figure 6:
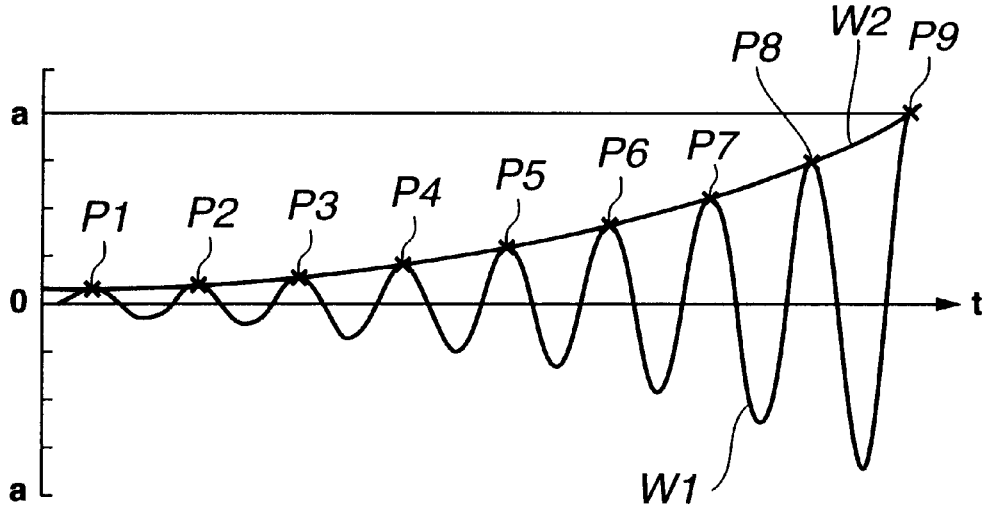
FIG. 6 is a graph showing a motion of a movable member during a resonance initialization control.

At step S5 following to the affirmative decision at step S2, controller 21 calculates the increase-degree α of the amplitude of movable member 6 on the basis of the position information z stored in controller 21. In this embodiment, controller 21 accumulates the position z of movable member during the resonance initialization by repeatingly executing step S4 and forms a waveform W1 representative of an oscillation of movable member 6 during the resonance initialization as shown in FIG. 6. Controller 21 obtains peak points P1 to P9 of the respective cycles from the waveform W1 and obtains the increase-degree α from a curve W2 obtained by connecting the peak points P1 to P9 as shown in FIG. 6. Since an increase rate of curve W2 corresponds to the increase-degree α, the increase rate of curve W2 may be treated as the increase-degree α. When the increase-degree α is large, the resonance initialization is rapidly achieved. Therefore, in this rapidly achieved condition, controller 21 estimates that friction c is small. On the other hand, when the increase-degree α is small, the resonance initialization is not rapidly achieved and takes a relatively long time. Accordingly, in this late condition, controller 21 estimates that friction c is large.

Herein, by approximating the curve W2 with the following equation (2), the increase rate in this equation (2) is represented by a coefficient b of the equation (2).

$$a(1-e^{-bt})=At \tag{2}$$

In this equation (2), an amplitude at time t is At, and a maximum amplitude in this vibration system is a. The maximum amplitude a is represented by a distance between the neutral position and the initial position where movable member 6 is generally in contact with one of electromagnets 10 and 11, and in this embodiment a is equal to z1 (a=z1) as shown in FIG. 2.

Steps S1 and S4 constitutes initialization amplitude detecting means, and step S5 constitutes amplitude increase-degree calculating means.

Figure 7:
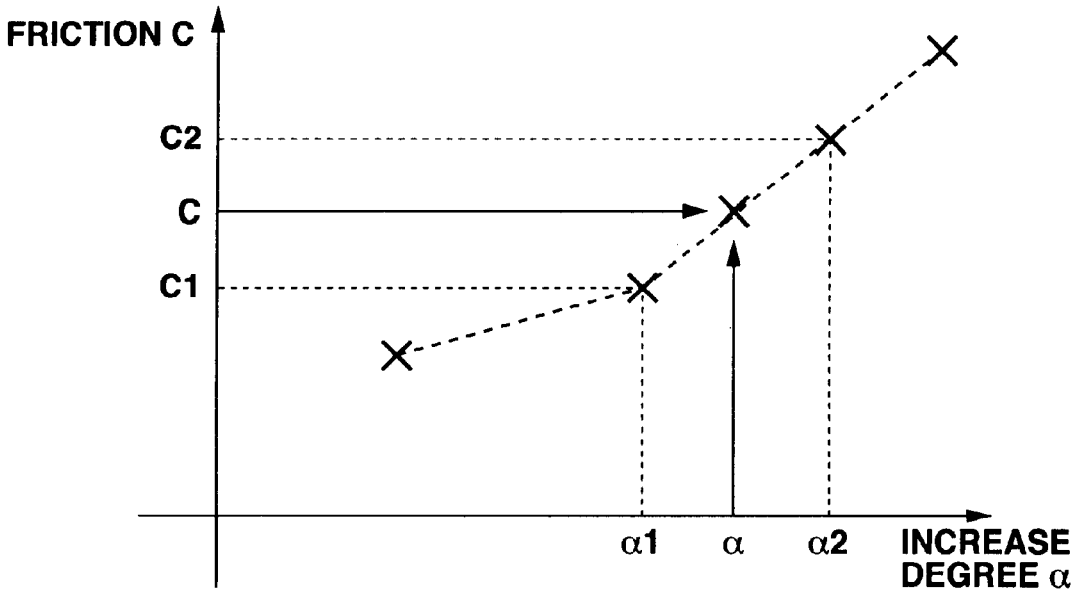
FIG. 7 is a graph showing an example of a map representing a relationship between an increase-degree and a friction.

At step S6, controller 21 estimates friction c on the basis of the calculated increase-degree α and the increase-fiction map 32. In this embodiment, a plurality of fictions c1 to cn corresponding to a plurality of increase-degrees α1 to αn have been previously measured and stored as increase-friction map 32. In order to facilitate the explanation, as to two frictions c1 and c2 corresponding to increase-degrees α1 and α2, the explanation will be made with reference to a graph of FIG. 7. When the obtained increase-degree α is near and between increase-degrees α1 and α2 stored, fiction c is interpolated from the stored two frictions c1 and c2 corresponding to increase-degrees α1 and α2 as shown in FIG. 7.

At step S7, controller 21 sets an optimum control parameter PRM with respect to the estimated friction c. For example, the relationship between optimum control parameters PRM1 to PRMn, frictions c1 to cn has been previously obtained by experiments and stored in a map of controller 21. Accordingly, controller 21 obtains the control parameter PRM employed in the actual control from the map and on the basis of the estimated friction c. This step S7 constitutes a control parameter setting means.

The control parameter PRM set at step S7 corresponds with a control gain G employed in the energizing control for electromagnets 10 and 11. If the velocity v of movable member 6 is estimated from an observer of the landing control, friction c may be directly reflected in the design of the observer.

At step S8, controller 21 reads coolant temperature Tw.

Figure 8:
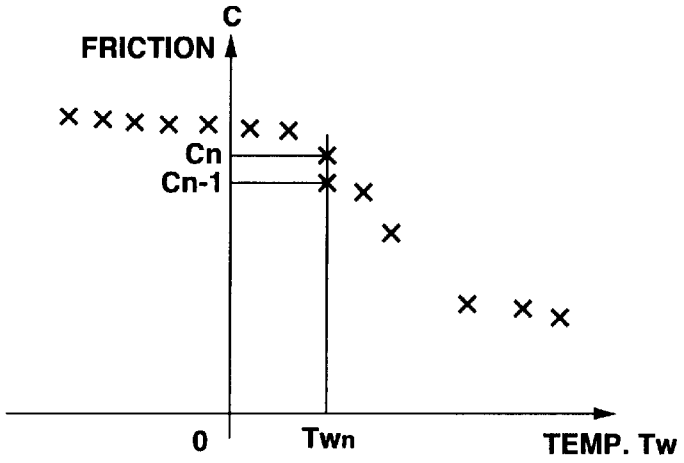
FIG. 8 is a graph showing an example of a temperature-friction map.

At step S9, controller 21 stores the estimated friction c as a relationship to the coolant temperature Tw and updates the temperature-friction map 33 by each execution of the resonance initialization. Referring to FIG. 8, the temperature-friction map 33 at an initial condition has stored only the coordinate axes coolant temperature Tw and friction c, and then gradually increases the information by each resonance initialization. It is preferable to update the map 33 with the new data when coolant temperature Tw of the new data whose corresponding coolant temperature Tw has already been stored is obtained. By this updating operation, the map 33 is gradually perfected, particularly fulfills the data in an ordinary temperature during the resonance initialization. This step S9 constitutes a friction quantity storing means.

Figure 9:
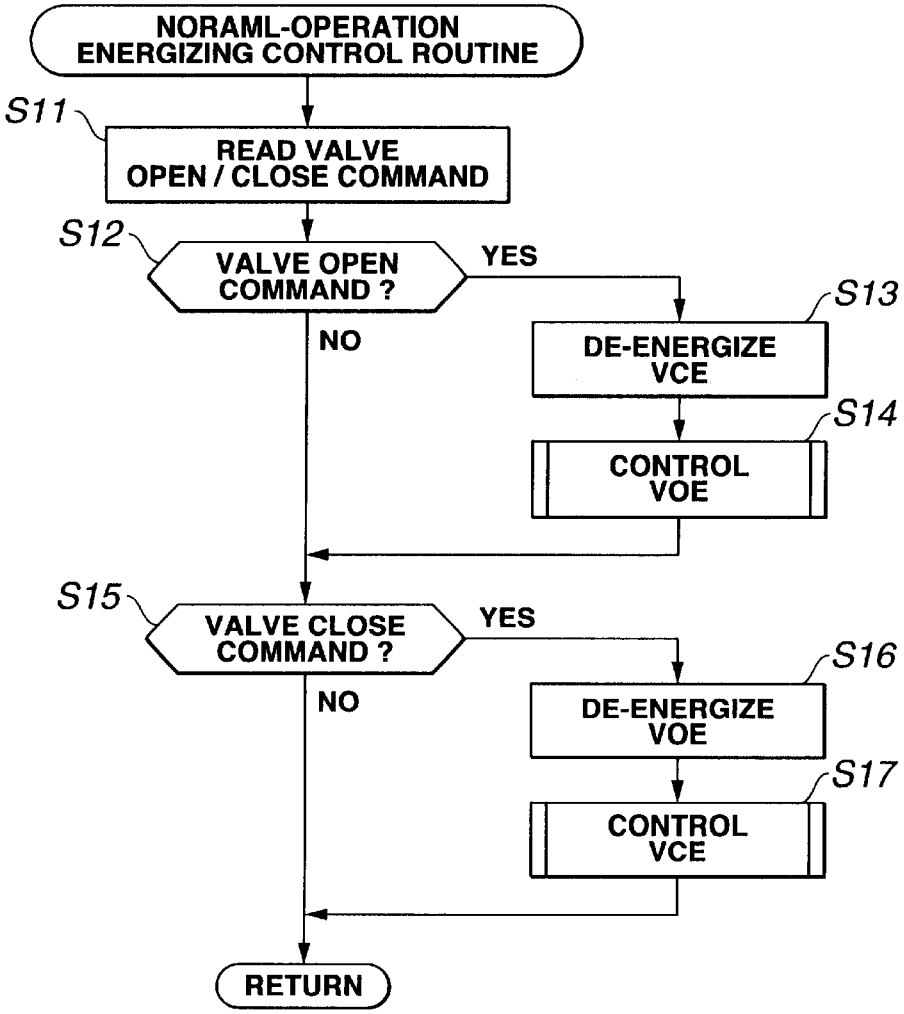
FIG. 9 is a flowchart showing an energizing control routine during the normal operating condition executed by the controller of the control system.

Next, the normal operation control routine executed by controller 21 after completing the resonance initialization will be discussed with reference to a flowchart of FIG. 9.

At step S11, controller 21 reads the valve opening/closing command for each valve unit 100 for each of intake and exhaust valves.

At step S12, controller 21 decides whether the read command is the valve opening command or not. When the decision at step S12 is affirmative, the routine proceeds to step S13. When the decision at step S12 is negative, the routine proceeds to step S15.

At step S13, controller 21 commands driver circuit 23 to de-energize the valve closing electromagnet (VCE) 11.

At step S14, controller 21 commands drive circuit 23 to energize the valve opening electromagnet (VOE) 10 and to execute the landing control. That is, the routine jumps to the landing control routine shown by a flowchart of FIG. 10. After the execution of the landing control routine as to valve opening electromagnet 10, the routine proceeds to step S15. The landing control routine will be discussed later.

At step S15, controller 21 decides whether the received commands include the valve close command or not. When the decision at step S15 is affirmative, the routine proceeds to step S16. When the decision at step S15 is negative, the routine proceeds to a return step.

At step S16 following to the affirmative decision at step S15, controller 21 commands driver circuit 23 to de-energize the valve opening electromagnet (VOE) 10.

At step S17, controller 21 commands drive circuit 23 to energize the valve closing electromagnet (VCE) 11 and to execute the landing control of the valve closing electromagnet 11. That is, the routine jumps to the landing control routine shown by the flowchart of FIG. 10. After the execution of the landing control routine as to valve closing electromagnet 11, the routine proceeds to the return block.

Figure 10:
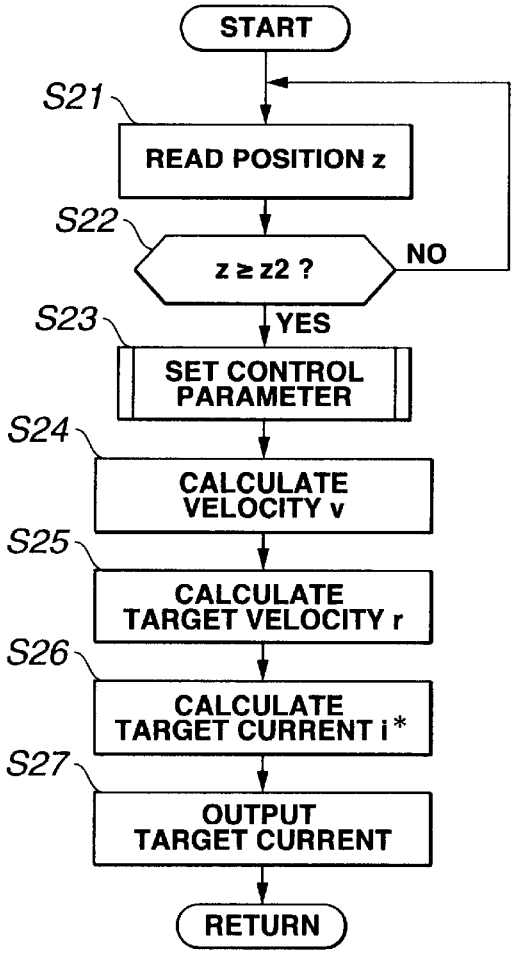
FIG. 10 is a flowchart showing a landing control executed by the controller of the present invention.

Next, the landing control will be discussed with reference to the flowchart of FIG. 10. As mentioned above, this routine is executed as a subroutine at steps S14 and S17 of FIG. 9, separately.

At step S21, controller 21 reads the position z of movable member 6.

At step S22, controller 21 decides whether the read position z is greater than or equal to the value z2 or not. That is, controller 21 decides whether or not movable member 6 is moved to a position where the electromagnetic force of valve opening electromagnet 10 (or valve closing electromagnet 11) affects movable member 6 as shown in FIG. 2. When the decision at step S22 is negative ($z<z2$), the routine returns to step S21. That is, steps S21 and S22 are repeated until the decision at step S22 becomes affirmative. When the decision at step S22 is affirmative ($z \geqq z2$), the routine proceeds to step S23.

At step S23, controller 21 executes the control parameter setting control to set control parameter PRM. More specifically, the routine jumps to the control parameter setting control routine shown by a flowchart of FIG. 11. After the execution of the control parameter setting control shown in FIG. 11, the routine returns to step S24. The control parameter setting routine will be discussed later.

At step S24, controller 21 detects velocity v of movable member 6. In this embodiment, controller 21 obtains velocity v on the basis of position z detected by position sensor 13. More specifically, velocity v of movable member 6 is obtained on the basis of a displacement per a unit time ($v=dz/dt$), such as a difference ($z_n-z_{n-1}$) between a previous position $z_{n-1}$ and a present position $z_n$. Velocity v of movable member 6 may be obtained by providing a velocity sensor for detecting the velocity of movable member 6, or designing an observer of the velocity v and estimating velocity v from this observer. In such a case, it is necessary to determine a model of a condition of a controlled system in order to design the observer of velocity v. Taking account of a friction resistance applied to movable portions of the controlled system (valve unit 100) and the elasticity of springs 5 and 9, friction c and is included in the model. Accordingly, if it is possible to estimate friction c according to the condition, this estimation contributes to further accurately estimate velocity v.

At step S25, controller 21 calculates target velocity r. Target velocity r is a function set according to position z of movable member 6, and it is preferable that the target velocity $r_{z2}$ at position z2 is set equal to a velocity $v_{z2}$ derived from the free vibration ($r_{z2}=v_{z2}$) when the position z is at a switching start point z2 ($z=z2$). As to the landing completion point, if it is set that when $z=z3$ the velocity vz3 is zero ($v_{z3}=0$), it becomes possible to prevent the collision between movable member 6 and valve opening electromagnet 10 and to stay movable member 6 at a predetermined position until the next valve closing operation.

At step S26, controller 21 calculates a target electric current i* to be supplied to valve opening electromagnet 10 in a manner of obtaining a feedback correction current by multiplying a difference (r−v) between target velocity r and actual velocity v of movable member 6 with control gain G and by adding the feedback correction current to an actual electric current i ($i^*=G(r-v)+i$).

At step S27, controller 21 controls drive circuit 23 to supply target electric current i* to the corresponding electromagnet 10, 11. Consequently, counter electromotive force is generated at the corresponding electromagnet according to the motion of movable member 6, and the electric current to be actually supplied to the corresponding electromagnet is determined. Further, the attracting force f of the corresponding electromagnet is applied to movable member 6 according to the actual electric current and the position z of movable member 6. A movable section including the movable member 6 in electromagnetic valve unit 100 is driven by the attracting force f and the biasing force of springs 5 and 9 so that valve member 3 is driven toward the full open position.

Figure 11:
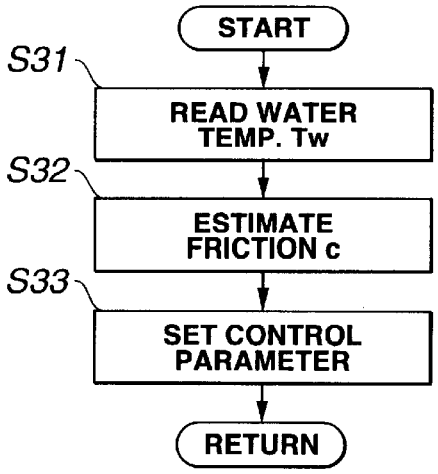
FIG. 11 is a flowchart showing a friction estimating routine for estimating a friction during a normal operating condition executed by the controller.

Next, the control parameter setting control will be discussed with reference to the flowchart of FIG. 11.

At step S31, controller 21 reads coolant temperature Tw.

At step S32, controller 21 estimates friction c with reference to the map 33.

At step S33, controller sets control parameter PRM on the basis of friction c estimated at step S32 and with reference to the map shown in FIG. 8. After the execution of step S33, the routine returns to the routine of the landing control.

With the thus arranged control system according to the present invention, it is possible to estimate the actual friction c at the temperature during the resonance initialization, and therefore it becomes possible to reflect the accurate friction c adapted to the change of temperature in the landing control of movable member 6. Therefore, it becomes possible to certainly prevent the collision between movable member 6 and electromagnets 10 and 11 and to increase the operation life of valve 3. Furthermore, since control parameter PRM, particularly, a control gain G is set on the basis of the estimated friction c, the landing control is further executed stably and certainly according to the fluctuation of friction.

The entire contents of Japanese Patent Application No. 2000-166533 filed on Jun. 2, 2000 in Japan are incorporated herein by reference.

Although the invention has been described above by reference to a certain embodiment of the invention, the invention is not limited to the embodiments described above. Modifications and variations of the embodiment described above will occur to those skilled in the art, in light of the above teaching. The scope of the invention is defined with reference to the following claims.

What is claimed is:

1. A valve control apparatus comprising:

an electromagnetic valve unit having a pair of springs biasing a movable member aligned with a valve to a neutral position and a pair of electromagnets attracting the movable member to open and close the valve; and a control unit configured to;

perform an initialization control to move the movable member from the neutral position to a predetermined initial position by alternatively energizing the electromagnets at a cycle corresponding to a natural frequency of a vibration system of the movable member, detect an amplitude of oscillation of the movable member during the initialization control, calculate an increase-degree of the detected amplitude, and estimate a friction quantity of the vibration system on the basis of the calculated increase-degree.

2. A valve control apparatus as claimed in claim 1, wherein the control unit is further configured to determine a control parameter employed in controlling the electromagnetic valve unit based on the estimated friction quantity.

3. A valve control apparatus as claimed in claim 1, wherein the control unit is further configured to detect temperature corresponding to lubricating oil temperature, and store the estimated friction quantity in relation with the temperature when the initialization control is performed.

4. A valve control apparatus as claimed in claim 3, wherein the control unit determines a control parameter employed in controlling the electromagnetic valve unit for a normal operation after completion of the initialization control, wherein the control parameter is calculated based on the stored estimated friction quantity with reference to the detected temperature when the normal operation is performed.

5. A valve control apparatus as claimed in claim 1, wherein the control unit accumulates positions of the movable member during the initialization control, and detects the amplitude of oscillation of the movable member based on the accumulated positions.

6. A valve control apparatus as claimed in claim 1, wherein the control unit obtains peak points of the oscillation of the movable member, and calculates the increase-degree of the amplitude based on the peak points.

7. A valve control system comprising:

an electromagnetic valve unit comprising a valve, a pair of electromagnets arranged in spaced relationship from one another in axial alignment with the valve so as to form a space, a movable member axially movably disposed in the space between the electromagnets, the movable member being interlocked with the valve, a pair of springs biasing the movable member so as to locate the movable member at an intermediate portion of the space when both of the electromagnets are de-energized; and a controller connected to said electromagnetic valve unit, said controller executing an initialization control for moving the movable member to a start position by repeatingly energizing the electromagnets according to a natural frequency of a vibration system of said electromagnetic valve unit, said controller, detecting an amplitude of oscillation of the movable member during the initialization control, calculating an increase-degree of the detected amplitudes, and estimating a friction quantity of the vibration system on the basis of the calculated increase-degree.

8. The valve control system as claimed in claim 7, wherein said controller determines a control parameter employed in controlling electric current supplied to the electromagnets, on the basis of the estimated friction quantity.

9. The valve control system as claimed in claim 7, wherein said controller detects a temperature corresponding to a temperature of lubricating oil for lubricating movable portions of said electromagnetic valve unit, and stores the estimated friction quantity determined based on a relationship between the friction quantity and the temperature.

10. The valve control system as claimed in claim 9, wherein said controller determines the friction quantity from the relationship and the detected present temperature indicative of lubricating oil temperature, and said controller determines a control parameter employed in controlling electric current supplied to the electromagnets, on the basis of the estimated friction quantity.

11. The valve control system as claimed in claim 7, wherein said controller accumulates positions of the movable member during the initialization control and determines a first waveform representative of oscillation of the movable member during the initialization control, said controller determines a second curve representative of the increase-degree of the oscillation during the initialization control from the first waveform.

12. The valve control system as claimed in claim 7, wherein said controller comprises a parameter map representing a relationship between a control parameter and the friction quantity and determines the control parameter from the parameter map and the estimated friction quantity.

13. An engine valve control system for electromagnetically controlling each of intake and exhaust valves of an internal combustion engine, said valve control system comprising:

an electromagnetic valve unit comprising a pair of electromagnets arranged in spaced relationship from one another in axial alignment with the valve so as to form a space, a movable member axially movably disposed in the space between the electromagnets, the movable member being contacted with the valve, a pair of springs biasing the movable member so as to locate the movable member at an intermediate portion of the space when both of the electromagnets are de-energized; and a controller connected to said electromagnetic valve unit, said controller detecting amplitudes of oscillation of the movable member during the initialization control, said controller calculating an increase-degree of the detected amplitudes, said controller estimating a friction quantity of the vibration system on the basis of the calculated increase-degree, said controller controlling said electromagnetic valve unit on the basis of a control parameter determined by the estimated friction quantity.

14. A control system for controlling an electromagnetic valve unit, the electromagnetic valve unit comprising a valve, a pair of electromagnets arranged in spaced relationship from one another in axial alignment with the valve so as to form a space, a movable member axially movably disposed in the space between the electromagnets while being interlocked with the valve, and a pair of springs biasing the movable member so as to locate the movable member at an intermediate portion of the space when both of the electromagnets are de-energized, the control system comprising;

initialization amplitude detecting means for detecting amplitudes of oscillation of the movable member during the initialization control;

amplitude increase-degree calculating means for calculating an increase-degree of the detected amplitudes;

friction quantity estimating means for estimating a friction quantity of the vibration system on the basis of the calculated increase-degree; and controlling means for controlling electric current supplied to the electromagnets based on the estimated friction quantity to land the movable member on the electromagnets at a predetermined velocity.

15. A method for controlling an electromagnetic valve unit, the electromagnetic valve unit being arranged to operate a valve by electromagnetically controlling a pair of electromagnets so as to displace a movable member disposed in a space between the electromagnets which receiving biasing force of a pair of springs, the method comprising:

detecting amplitudes of oscillation of the movable member during the initialization control;

calculating an increase-degree of the detected amplitudes;

estimating a friction quantity of the vibration system on the basis of the calculated increase-degree; and controlling electric current supplied to the electromagnets based on the estimated friction quantity to land the movable member on the electromagnets at a predetermined velocity.

* * * * *